United States Patent [19]

Hall et al.

[11] Patent Number: 4,893,022

[45] Date of Patent: Jan. 9, 1990

[54] CLOSURE FOR CASKS CONTAINING RADIOACTIVE MATERIALS

[75] Inventors: George V. B. Hall, Bethel Park, Pa.; Charles W. Mallory, Severna Park, Md.

[73] Assignee: Westinghouse Electric Corp., Pittsburgh, Pa.

[21] Appl. No.: 109,507

[22] Filed: Oct. 19, 1987

[51] Int. Cl.[4] ..... G21F 5/00

[52] U.S. Cl. ..... 250/506.1; 250/507.1; 376/272; 220/327; 220/256

[58] Field of Search ..... 250/506.1, 507.1; 376/272; 220/327, 328, 256

[56] References Cited

U.S. PATENT DOCUMENTS

| | | | |
|---|---|---|---|
| 195,898 | 10/1877 | Lester | 220/327 |
| 4,302,680 | 11/1981 | Ahner et al. | 250/506.1 |
| 4,330,711 | 5/1982 | Ahner et al. | 250/506.1 |
| 4,594,214 | 6/1986 | Popp et al. | 250/506.1 |
| 4,634,873 | 1/1987 | Bezer et al. | 250/506.1 |
| 4,636,645 | 1/1987 | Kessinger | 250/506.1 |
| 4,676,712 | 6/1987 | Hayward et al. | 376/272 |
| 4,754,894 | 7/1988 | Simon et al. | 250/506.1 |

FOREIGN PATENT DOCUMENTS

| | | | |
|---|---|---|---|
| 149733 | 7/1981 | Fed. Rep. of Germany | 250/506.1 |
| 3031211 | 3/1982 | Fed. Rep. of Germany | 250/506.1 |

*Primary Examiner*—Janice A. Howell
*Assistant Examiner*—John A. Miller
*Attorney, Agent, or Firm*—L. A. DePaul

[57] ABSTRACT

An improved closure for covering and sealing a radioactive waste cask of the type having an opening circumscribed by a ledge is disclosed herein. The closure generally comprises an inner lid having an outer edge circumscribed by a gasket which is seatable over the ledge which circumscribes the opening, and an outer lid which is securable around the cask opening by either a screw-type or a breech-lock mechanism. In either case, the outer lid may be rotated into locking engagement with the container without imparting rotational forces to the gasket of the inner lid, thereby protecting the gasket from unnecessary rubbing forces. If the breech-lock mechanism is used, inner and outer lids may be rotatably connected to one another by a minimum of three suspension pin assemblies equidistantly spaced around the edges of both. The rotatable connection afforded by these suspension pin assemblies unitizes the closure while advantageously allowing the gasket of the inner lid to remain stationary while the outer lid is secured to the cask opening. To secure the gasket of the inner lid against the ledge of the cask opening, the outer lid is provided with a plurality of jack bolts engaged in threaded bores which extend completely through the outer lid. After the closure is secured over the cask opening, these jack bolts may be screwed through the outer lid into engagement against the inner lid, thereby forcing the inner lid gasket into sealing engagement with the ledge of the cask opening.

15 Claims, 7 Drawing Sheets

CLOSURE FOR CASKS CONTAINING RADIOACTIVE MATERIALS

BACKGROUND OF THE INVENTION

This invention generally relates to casks for transporting radioactive materials, and is specifically concerned with an improved double-lidded closure capable of closing and sealing such a cask without the application of rubbing or scraping forces on the gasket seal between the cask and the closure.

Casks for transporting radioactive materials such as the waste products produced by nuclear power facilities are known in the prior art. The purpose of such casks is to ship radioactive wastes in as safe a manner as possible. Such casks may be used, for example, to ship high-level vitrified waste cannisters to a permanent waste isolation site or fuel rods to a reprocessing facility. At the present time, relatively few of such transportation casks have been manufactured and used since most of the spent fuel and other wastes generated by nuclear power plants are being stored at the reactor facilities themselves. However, the availability of such on-site storage space is steadily diminishing as an increasing amount of fuel assemblies and other wastes are loaded into the spent-fuel pools of these facilities. Additionally, the U.S. Department of Energy (D.O.E.) has been obligated, by way of the National Waste Policy Act of 1983, to move the spent-fuel assemblies from the on-site storage facilities of all nuclear power plants to a federally operated nuclear waste disposal facility starting in 1998.

While the transportation casks of the prior art are generally capable of safely transporting wastes such as spent fuel to a final destination, there is a need for improvement, particularly with respect to the closures used to close and seal such casks. However, before these areas of potential improvement can be fully appreciated, some understanding of the structure and operation of prior art closures is necessary.

The primary closure for a typical prior-art transportation cask is generally formed from a circular lid which is attached over the open end of the cask by twenty-four bolts. The threaded ends of these bolts are received in twenty-four bores uniformly provided around the circumference of the lid near the outer edge thereof. Additionally, a bolt ring welded around the open end of the cask includes twenty-four threaded bores which are registerable with the ends of the bolts when they are extended completely through the closure lid. To effect a fluid-tight seal between the lid and the bolt ring, the lid is circumscribed by a gasket or o-ring of resilient material. In operation, the twenty-four closure bolts are inserted into the bolt bores around the lid. The lid is then hoisted over the bolt ring of the casks, and the threaded ends of the bolts extending through the lid bores are carefully aligned with the threaded bores in the ring. The bolts are then screwed into the threaded bores of the bolt ring in order to effect the closure. However, to insure that a uniform engagement force is applied around the ring-like gasket sandwiched between the outer edges of the lid and the bolt ring, the twenty-four bolts must be tightened in accordance with an intricate torquing pattern, wherein bolts oppositely disposed from one another across the cask lid are simultaneously tightened. Implementation of such a torquing pattern requires a significant expenditure of the time of the personnel in charge of closing the casks, which in turn causes them to be exposed to some amount of radioactivity. Moreover, if any of the threaded holes in the bolt ring of the casks should become damaged (as, for example, by an inadvertent over tightening of a particular bolt) the entire cask could become unsealable and hence useless since the bolt ring is essentially a non-replaceable part of the cask, being permanently welded to the cask walls. Still another drawback of bolt-ring closure designs is the fact that they are often not as structurally strong as the cask walls themselves. Thus, they often provide the weakest point in the overall cask structure which is the most likely to break in the event of an accident. A fourth significant drawback to this prior art closure design is the fact that significant wiping and scraping forces are often applied to the gasket as the bolts in the lid are being azimuthly aligned with the threaded bolt holes in the bolt ring. Such scraping or wiping forces can seriously jeopardize the sealing ability of the gasket, and will, at the very least, accelerate its wear-out. Finally, the minimum diameter of the bolt ring is smaller than the diameter of the mouth of the opening it circumscribes. Consequently, a bolt ring often provides an unwanted lip or flange around the opening that interferes with the loading and unloading of the cask.

Clearly, what is needed is a closure for a cask assembly which corrects all of aforementioned drawbacks associated with the prior art. Ideally, such a closure should avoid the application of scraping or wiping forces to the gasket seal in order to prevent the premature wear-out of the gasket. Moreover, such a closure should be rapidly attachable to the open end of the casks so as to minimize the exposure of the personnel implementing the closing of the casks to potentially harmful radiation, and devoid of any unwanted lips or flanges that interfere with the loading and unloading of the cask. Finally, it is desirable that the closure be at least as strong as the cask walls themselves, and capable of maintaining an effective seal around the casks in the event of an accident which applies substantial shock forces to the casks.

SUMMARY OF THE INVENTION

Generally, the invention is an improved closure for covering and sealing a ledge-surrounded opening in a cask of the type used to contain radioactive material that solves all the aforementioned drawbacks. The improved closure comprises an inner lid having an outer edge that is seatable over the ledge of the opening, and an outer lid rotatably connected to the inner lid which is securable around the cask opening when the outer lid is rotated. The improved closure preferably includes a breech-lock mechanism for securing the outer lid to the opening which is formed by a first set of flanges uniformly spaced around the outer lid that are insertable through the spaces between the first set of flanges and movable therebehind when the outer lid is rotated. In lieu of a breech-lock mechanism, complementary screw threads may be provided between the outer lid and the cask opening. To effect a seal between the improved closure and the cask opening, the outer edge of the inner lid includes a gasket that engages the ledge circumscribing the cask opening when the lid is secured therearound. However, because no rotational forces are transferred from the outer lid to the inner lid when the outer lid is rotated into engagement with the cask opening, all wiping or scraping between the gasket and the ledge during the closing operation of the lid is eliminated.

The improved closure may include a means for rotatably connecting the inner and outer lids which is formed by a plurality of suspension pin assemblies. These suspension pin assemblies may include brackets which are mounted uniformly around the circumference of the outer lid, and pins which are captured and slidably movable within a groove which extends circumferentially around the edge of the inner lid. Such a rotatable mounting between the inner and outer lids allows the inner lid to rotate freely with respect to the outer lid without compromising the shielding properties of either lid.

The improved closure may further include a means for depressing the outer edge of the inner lid into sealing engagement against the ledge that circumscribes the opening of the cask. This depressing means may take the form of a plurality of bolts engaged within threaded bores which extend completely through the outer lid. Each of these bolts may be screwed into engagement against the top surface of the inner lid, thereby depressing the edge of the inner lid into tight engagement around the ledge which circumscribes the cask opening.

Finally, the improved closure may include a lock means for preventing the outer lid from rotatably moving relative to the inner lid. In the preferred embodiment, this lock means takes the form of the bracket having a leg which is insertable in the space between the flanges of both the inner and the outer lid when the outer lid is secured to the cask opening. The locking bracket is detachably mountable onto the outer lid of the improved closure.

BRIEF DESCRIPTION OF THE SEVERAL FIGURES

FIG. 1 is a perspective view of a novel cask assembly onto which the improved closure of the invention may be used in conjunction with;

Figure 6A:
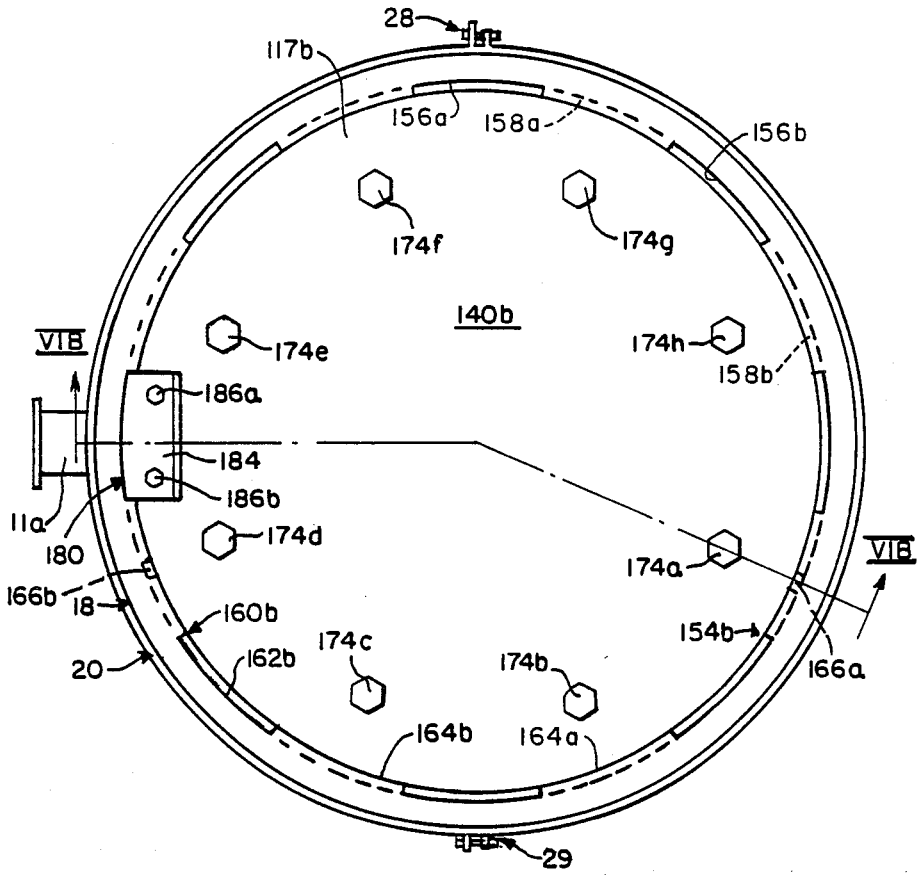
FIG. 6A is a plan view of a breech-lock, double-lidded embodiment of the improved closure that may be used to close and seal both the shield insert and the outer container.
Figure 6B:
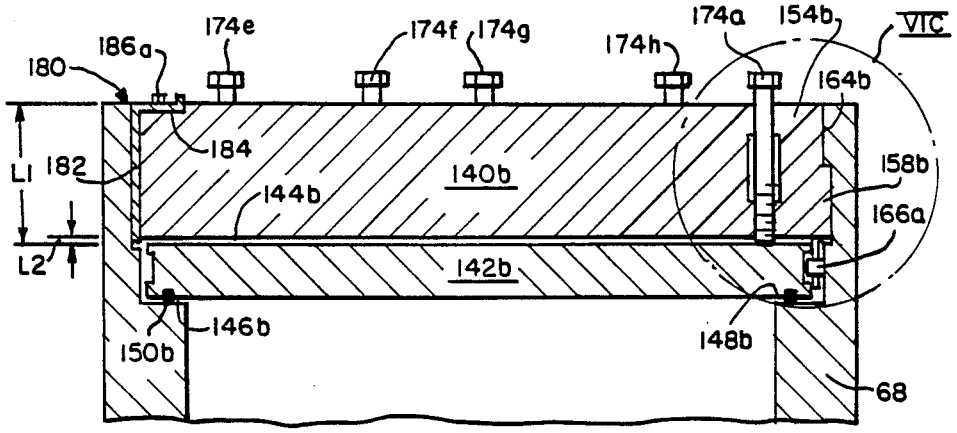
Figure 6C:
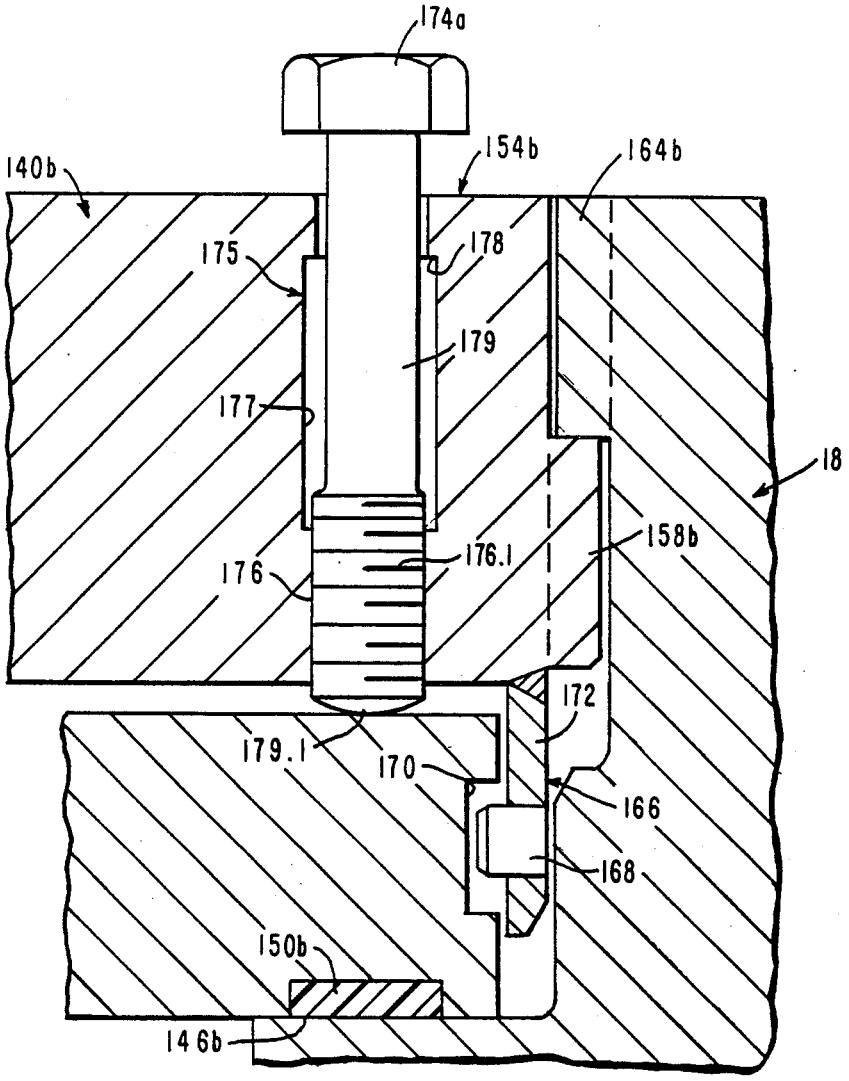

FIG. 6B is a cross sectional view of the improved closure illustrated in FIG. 6A along the lines 6B—6B, and FIG. 6C is an enlarged view of the area encompassed within the circle in FIG. 6B, illustrating how the flanges and notches which circumscribe the outer edge of the closure and the inner edge of the access opening of the outer container interfit with one another, and further illustrating how the sealing bolts sealingly engage the gasket of the inner lid around this opening.

DETAILED DESCRIPTION OF THE PREFERRED EMBODIMENT

Figure 1:
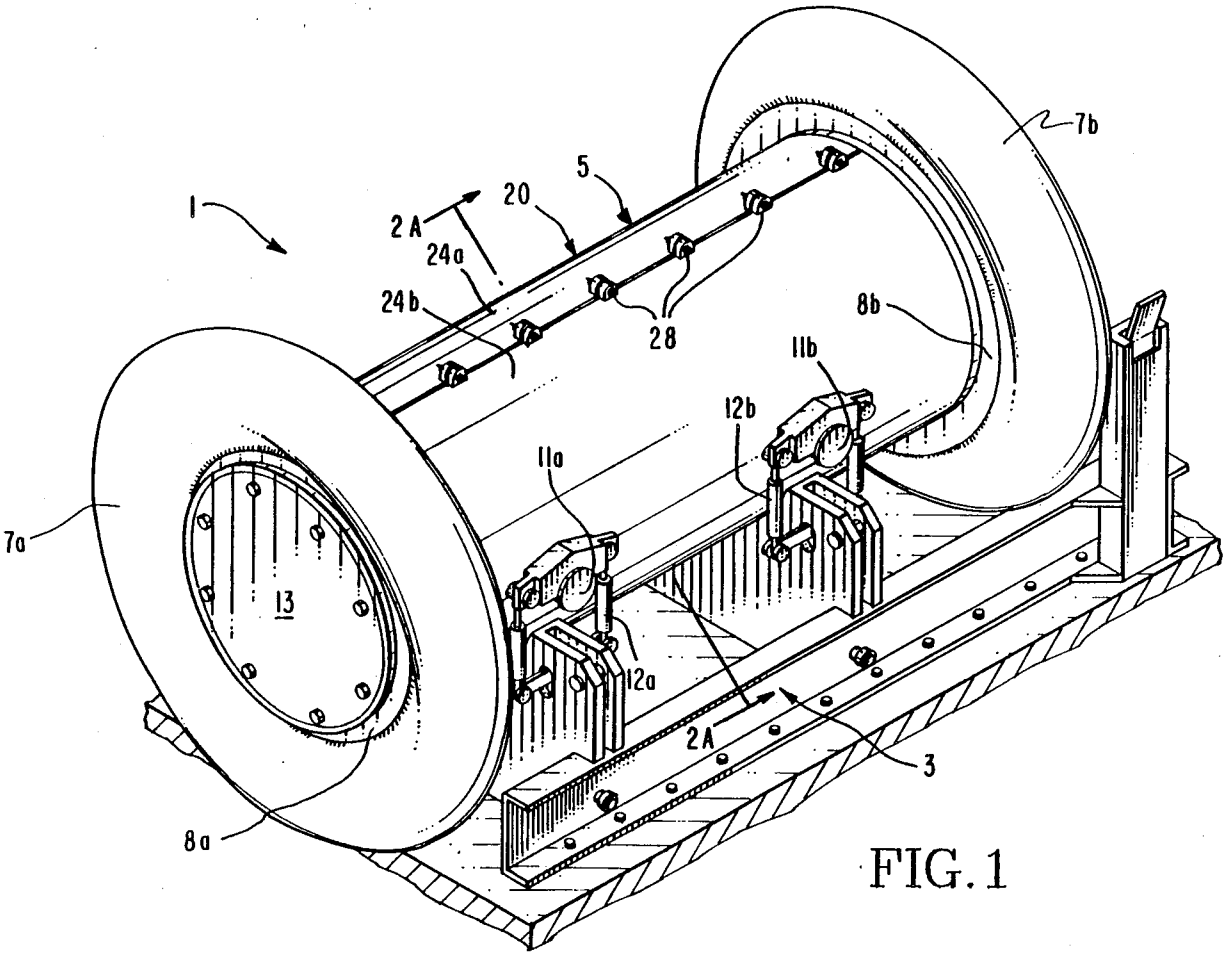
Figure 3:
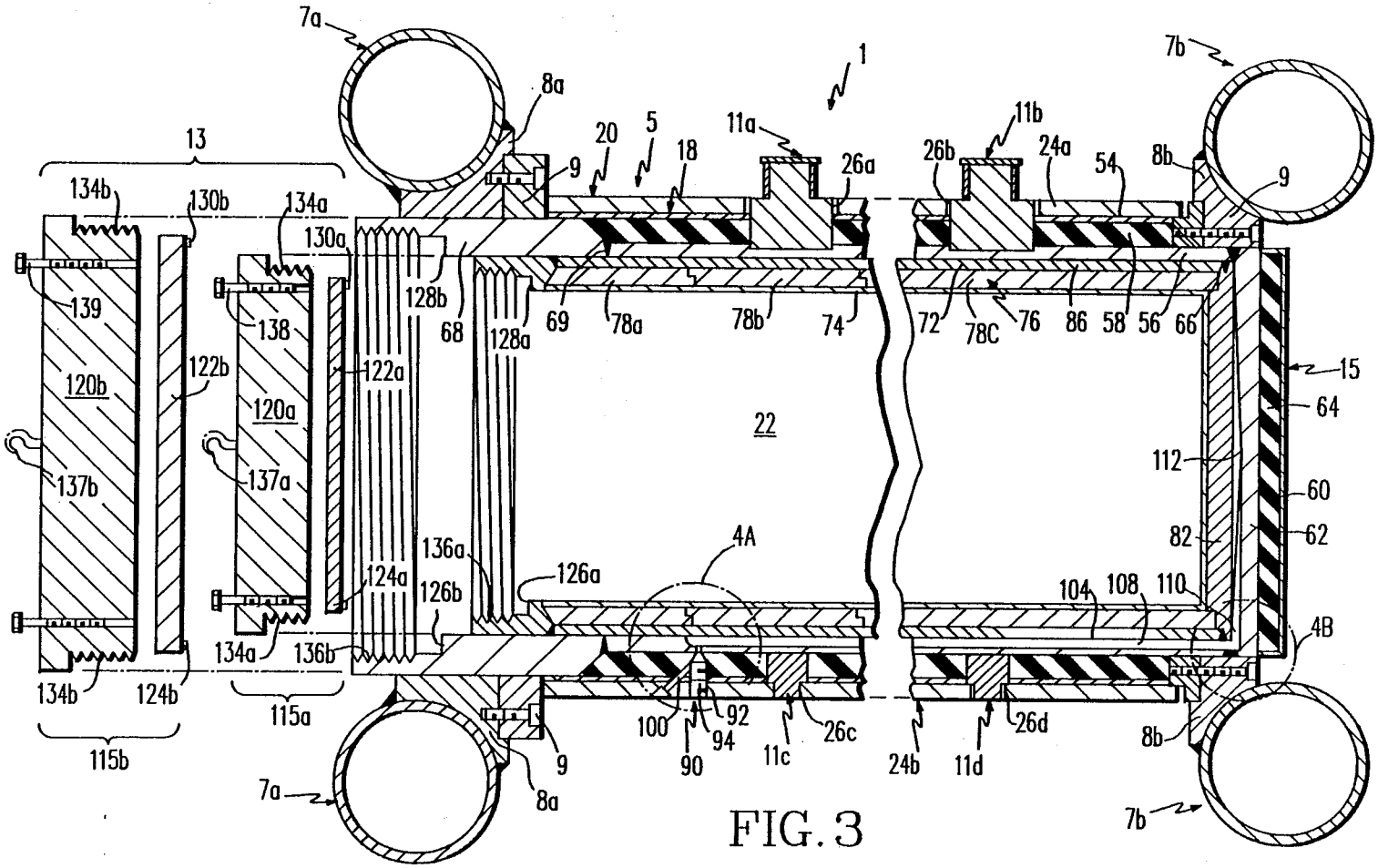
FIG. 3 is a cross sectional side view of the cask assembly, showing how a screw-type, double-lidded embodiment of the improved closure (shown in exploded form) may be used to close and seal both the shield insert and the outer container of the cask assembly.
Figure 5:
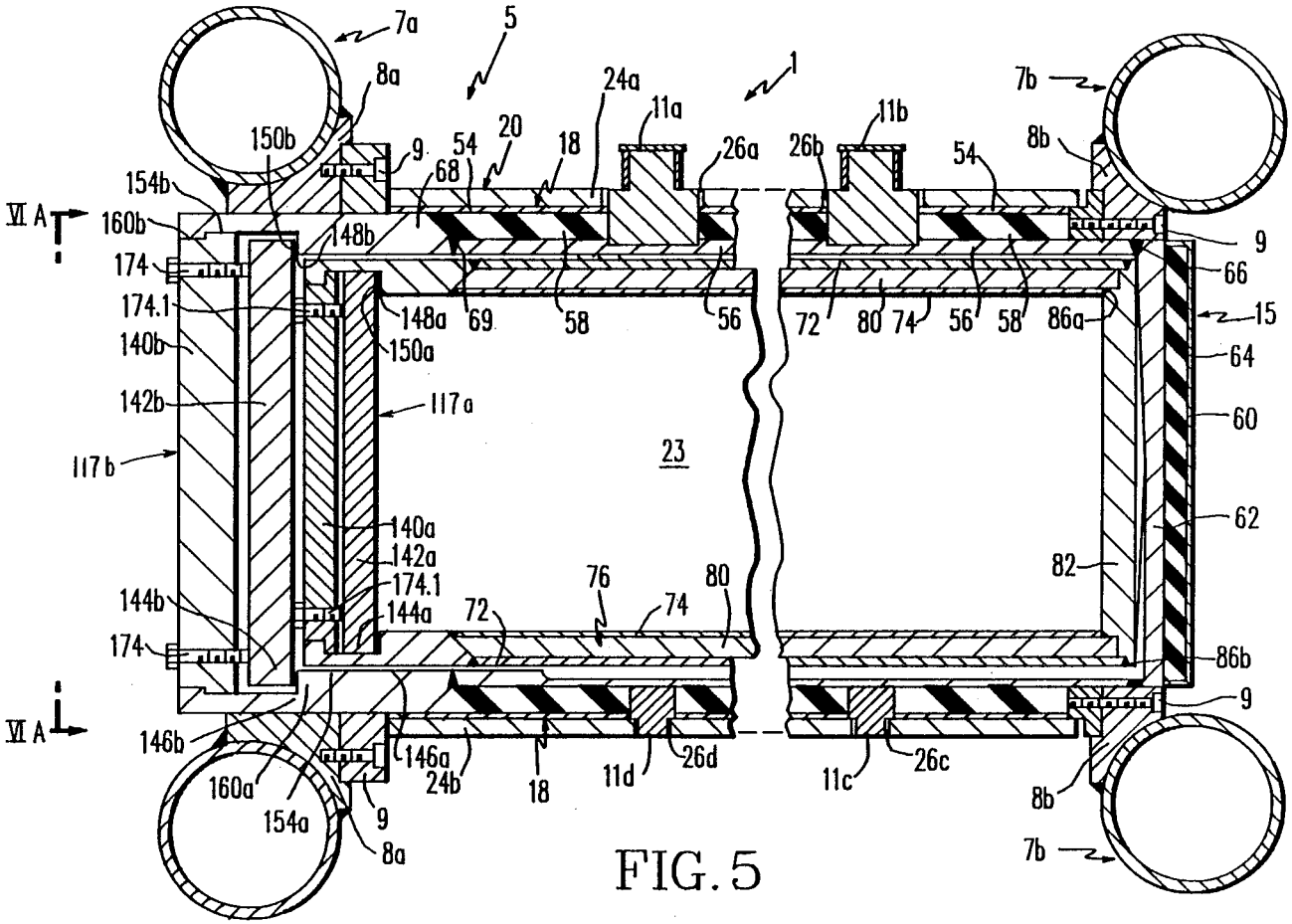
FIG. 5 is a cross sectional side view of the cask assembly used in connection with the invention, showing an alternative shield insert disposed within the interior of the outer container that is particularly well suited for carrying neutron-emitting radioactive materials.

With reference now to FIG. 1, wherein like numerals designate like components throughout all the several figures, the novel cask assembly 1 that the invention directly applies to is particularly useful in carrying radioactive materials of different activities aboard a vehicle such as a tractor-trailer. In use, the cask assembly 1 is typically mounted within a novel biaxial restraint cradle 3, which in turn is secured onto the trailer of a tractor-trailer (not shown). Generally, the cask assembly itself has a cylindrical body 5 which is circumscribed on either end by toroidal impact limiters 7*a*, and 7*b*. Each of these impact limiters 7*a*, 7*b* is a donut-shaped shell of yieldable aluminum which is approximately one-half of an inch thick. Each of the toroidal impact limiters 7*a*, 7*b* is mounted around its respective end of the cylindrical body 5 by means of a support ring assembly 8*a*, 8*b* which in turn is secured to the cylindrical body 5 by a plurality of bolts 9 (shown in FIGS. 3 and 5). Disposed between the impact limiters 7*a*, 7*b* are two pairs of opposing trunnions 11*a*, 11*b* and 11*c*, 11*d*. The two pairs of trunnions are disposed 180 degrees apart around the cylindrical body 5 of the cask assembly 1, and are receivable within two pairs of turnbuckle assemblies 12*a*, 12*b*, and 12*c*, 12*d* (of which only 12*a* and 12*b* are visible) that form part of the novel cradle 3. The cylindrical body 5 is capped by a closure 13 at one end, and an end plate assembly 15 (shown in FIG. 3) at the other end. As is best seen in FIGS. 3 and 5, the cylindrical body 5 of the cask assembly 1 is generally formed by an outer container 18 which is surrounded by a thermal protection shell 20 on its exterior, and which contains in its interior one of two different shield inserts 22 or 23, depending upon the activity and type of radiation emitted by the material to be transported. While only two specific types of shield inserts 22 and 23 are specifically disclosed herein, it should be noted that the inserts 22 and 23 are merely exemplary, and that the cask assembly 1 may in fact be used with any number of different types of shield inserts formed of different shielding materials and of different wall thicknesses for handling radioactive material within a broad range of activity and radiation type.

Figure 2A:
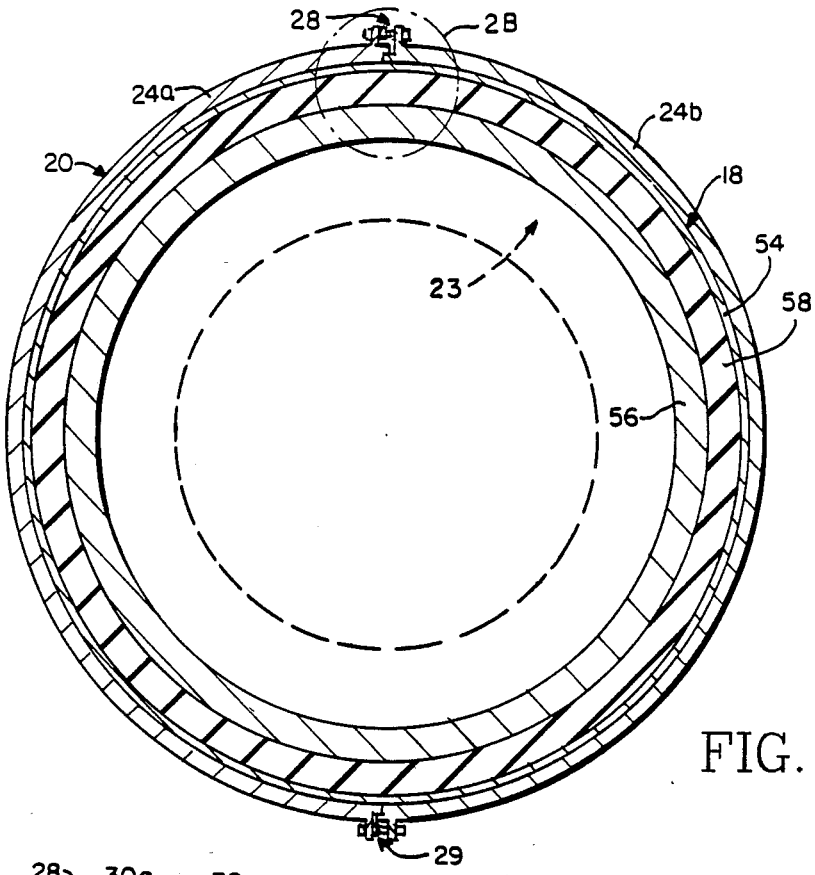
FIG. 2A is a cross sectional view of the cask assembly illustrated in FIG. 1 along the line 2A—2A with its toroidal impact limiters removed.
Figure 2B:
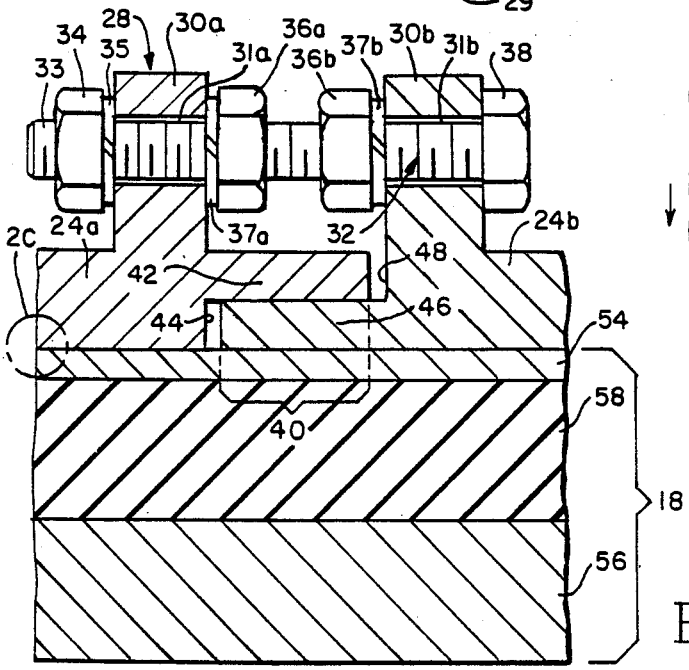
FIG. 2B is an enlarged, cross sectional view of the connecting assembly circled in FIG. 2A which rigidly interconnects the semi-cylindrical sections that form a thermal protection shell for the cask assembly.
Figure 2C:
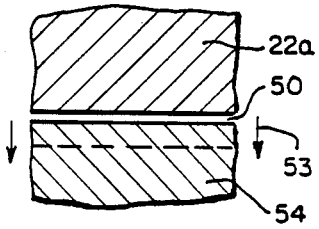
FIG. 2C is an enlargement of the area circled in FIG. 2B, demonstrating how the distance between the outer surface of the outer container and the inner surface of the thermal protection shell increases when the shell is exposed to a source of thermal radiation such as a fire.

With reference now to FIGS. 2A, 2B, and 2C, the thermal protection shell 20 which circumscribes the outer container 18 of the cask assembly 1 is formed from a pair of semi-cylindrical shell sections 24*a*, 24*b* which are rigidly interconnectable into thermal contact with one another. Each of the shell sections 24*a*, 24*b* includes a pair of cut-outs 26 (shown in FIG. 3) for admitting the trunnions 11*a*, 11*b*, 11*c*, and 11*d*. Each of the shell sections 24*a*, 24*b* is formed from a metal having a thermal coefficient of expansion which is greater than that of the metal that forms the walls of the outer container 18, and which is at least as heat-conductive as the metal which forms the walls 54 of the outer container 18. When the outer wall of the outer container 18 is formed from steel, the shell sections 24*a*, 24*b* are preferably formed from aluminum or magnesium or an alloy of either or both of these metals. The coefficient of thermal expansion of these metals is approximately twice that of the thermal coefficient expansion of steel. Moreover, the high coefficient of thermal conductivity of each such metal insures that the thermal protection shell 20 will not significantly obstruct the conduction of decay heat conducted through the walls of the outer container 18 which is generated by the radioactive material held within the cask assembly 1. When the diameter of the outer container 18 is between forty and sixty inches, a wall thickness of approximately one-half of an inch is preferred for both of the shell sections 24*a*, 24*b*. Such a wall thickness renders the thermal protection shell 20, as a whole, thin enough to be conveniently retrofitted over many existing transportation casks without significantly adding to the weight thereof, yet is thick enough to maintain the structural integrity needed to expand away from the outer walls of the outer container when exposed to a source of intense thermal radiation, such as a fire. Finally, the preferred thickness of one-half of an inch provides enough mass to give the entire thermal protection shell 20 a significant latent heat of fusion, which will provide still more thermal protection through oblation should the cask 1 be exposed to intense heat.

A plurality of top and bottom connecting assemblies 28, 29 are used to rigidly interconnect the two semicylindrical shell sections 24*a*, 24*b*. Since each of the connecting assemblies 28, 29 are identical in structure, a description will be made only of the top connecting assembly 28 circled in FIG. 2A.

This connecting assembly 28 is formed from a pair of opposing semicircular lugs 30*a* and 30*b* which are integrally formed along the edges of the shell sections 24*a* and 24*b* respectively. These lugs 30*a*, 30*b* include mutually alignable bore holes 31*a* and 31*b* for receiving a connecting bolt 32. The threaded end 33 of the bolt 32 is engaged to a tension nut 34 as shown in FIG. 2B. The distance between the two lugs 30*a*, 30*b* (and hence the distance between the edges of the shell sections 24*a*, 24*b*) is largely determined by the extent of which the end 33 and the bolt 32 is threaded through the tension nut 34. A lock washer 35 is disposed between the tension nut 34 and the lug 30*a* to prevent the nut 34 from becoming inadvertently loosened. A pair of lock nuts 36*a*, 36*b* are threadedly engaged near the center portion of the connecting bolt 32 between the two lugs 30*a* and 30*b*. These lock nuts provide two functions. First, when properly adjusted, they prevent the tension nut 34 from applying excess tensile forces between the two shell sections 24*a* and 24*b* which might interfere with their expansion away from the outer container 18 in the event the cask assembly is exposed to a fire or other source of intense heat. Second, the nuts 36*a*, 36*b* eliminate all slack or play between the lugs 30*a*, 30*b*, thus insuring that the connecting assembly 28 rigidly interconnects the two shield sections 30*a*, 30*b*. Again, lock washers 37*a*, 37*b* are disposed between the lock nuts 36*a* and 36*b* and their respective lugs 30*a* and 30*b* to prevent any inadvertent loosening from occurring.

An overlap 40 is provided between the edges of the two shell sections 24*a* and 24*b* to establish ample thermal contact and hence thermal conductivity between these shell sections. The overlap 40 is formed from an outer flange 42 and recess 44 provided along the edge of shell section 24*a* which interfits with a complementary outer flange 46 and recess 48 provided along the opposing edge of shield section 24*b*. The actual length of the overlap 40 will vary depending upon the distance between the two lugs 30*a* and 30*b* as adjusted by the bolt 32, tension nut 34, and lock nuts 36*a* and 36*b*.

In operation, the two sections 24*a*, 24*b* of the thermal protection shell 20 are installed over the cask assembly 1 by aligning the various cutouts 26*a*, 26*b*, 26*c*, and 26*d* with the corresponding trunnions of 11*a*, 11*b*, 11*c*, and 11*d* which project from the cylindrical body 5, and placing the sections 24*a*, 24*b* together so that the lugs 30*a* and 30*b* of each of the connecting assemblies 28, 29 are in alignment with one another and the flanges and recesses 42, 44, and 48, 48 of each overlaps 40 are interfitted. Next, the bolt 32, tension nut 35, lock nuts 36*a*, 36*b*, and lock washers 35, 37*a*, and 37*b* are installed in their proper positions with respect to the lugs 30*a*, 30*b* of each of the connecting assemblies 28, 29. The tension nut 34 is then screwed over the threaded end 33 of connecting bolt 32 until the interior surface of each of the shell sections 24*a* and 24*b* is pulled into intimate thermal contact with the outside wall 54 of the outer container 18. In the preferred method of installing the thermal protection shield, the tension nut 34 of each of the connecting assemblies 28, 29 is initially torqued to a selected maximum on the threaded shaft of the bolt 32 until the nut 34 imparts a significant tensile force between the two lugs 30*a* and 30*b*. This tensile force tends to squeeze the two shell sections 24*a* and 24*b* together around the outer wall 54 of the outer container 18 in a clamp-like fashion, which in turn removes any significant gaps between the outer surface of the wall 54 and the inner surface of the shell sections 24*a* and 24*b* by bending these sections into conformity with one another. In the next step, each of the nuts 34 is relaxed enough to prevent these tensile clamping forces from interfering with the expansion of the thermal protection shell 20 in the event of a fire, yet not so much as to cause the surfaces of the shell 20 and the outer container from becoming disengaged with one another. Thereafter, the lock nuts 36*a* and 36*b* are tightened against the faces of their respective lugs 30*a* and 30*b* to remove all slack in each connecting assembly 28, 29. The end result is a rigid interconnection between opposing edges of the shield sections 24*a* and 24*b*, wherein each of the opposing lugs 30*a* and 30*b* is tightly sandwiched between the tension nut 34 and lock nut 36*a*, or the head of the bolt 38 and lock nut 36*b*, respectively.

If the outer container has no trunnions 11*a*, 11*b*, 11*c*, 11*d*, or other structural members which would prevent the surfaces of the shell 20 and outer container 18 from coming into intimate thermal contact, the shell 20 may assume the form of a tubular sleeve which may be, in effect, heat shrunk into contact over the container 18. This alternative method of installation comprises the steps of removing the impact limiters 7*a*, 7*b* heating the shell to a temperature sufficient to radially expand it, sliding it over the wall 54 of the outer container 18, allowing it to cool and contract into intimate thermal contact with the wall 54, and reinstalling the impact limiters *7a*, *7b*.

FIG. 2C illustrates the typical gap condition between the inner surface of the thermal protection shell 20 and the outer surface of the outer container 18. Under ambient conditions, these two opposing surfaces are either in direct contact with one another, or separated by only a tiny gap 50 which may be as much as one mil. Such a one mil separation at various points around the cask assembly 1 does not significantly interfere with the conduction of heat between the wall 54 of the outer cask 18, and the thermal protection shell 20. However, when the cask assembly 1 is exposed to a source of intense thermal radiation such as a fire, the substantially higher thermal coefficient of expansion of the aluminum or magnesium forming the shell 20 will cause it to expand radially away from the outer surface of the outer container 18, leaving an air gap 53 (shown in phantom) between the two surfaces. Moreover, since the thermal protection shield 20 is formed from a metal having good heat conductive properties, this differential thermal expansion is substantially uniform throughout the entire circumference of the shield 20, which means that the resulting insulatory air gap 53 is likewise substantially uniform. When this gas exceeds approximately two and one-half mils, the primary mode of heat transfer switches from conductive and convective to radiative. Thus, the three mil gap provides a substantial thermal resistance between the fire or other source of intense infrared radiation in the outer container 18 of the cask 1.

Figure 4B:
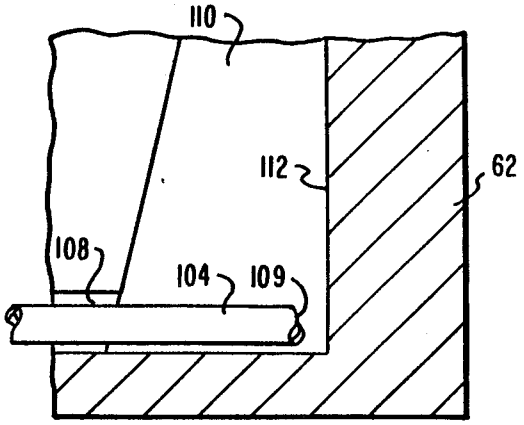
FIG. 4B is a cross sectional side view of the area encompassed within the lower circle in FIG. 3, showing how the bottom end of the drain tube fits into a fluid conducting groove cut into the conical bottom of the outer container of the cask assembly.
Figure 4A:
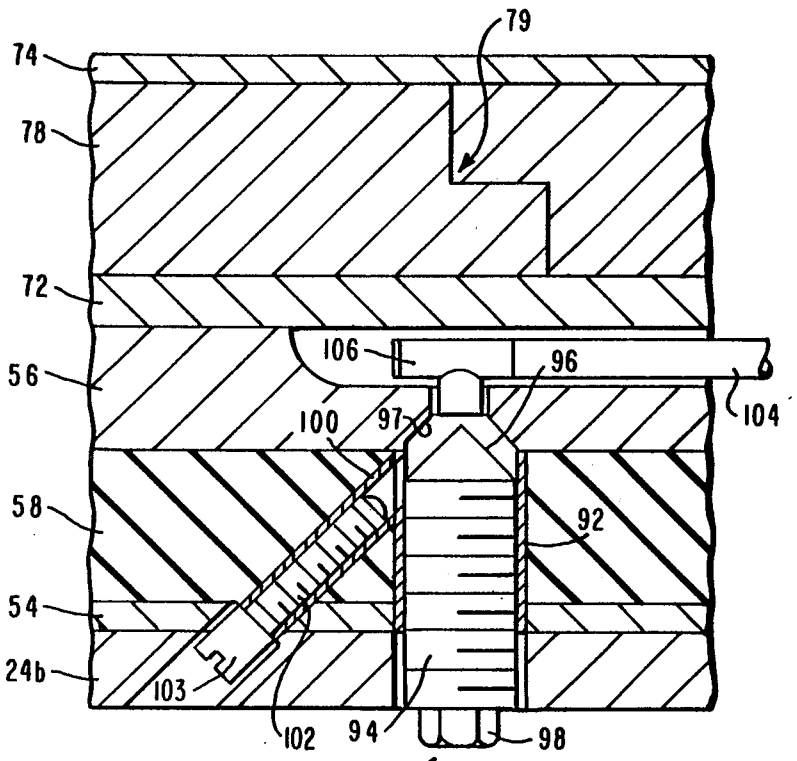
FIG. 4A is an enlarged cross sectional side view of the vent, purge, and drain assembly of the cask assembly circled in FIG. 3, showing the drain pipe, vent pipe, the drain and vent plugs, and the drain tube thereof.

With reference now to FIGS. 3, 4A, and 5, the side walls of the outer container 18 of the improved cask 1 are a laminate formed from the previously mentioned outer wall 54, an inner wall 56, and a center layer 58 of shielding material. In the preferred embodiment, the outer wall 54 is formed from low alloy steel approximately one-fourth of an inch thick. Such steel is economical, easy to manufacture, and a reasonably good conductor of heat. In the alternative, stainless steel may be used in lieu of low alloy steel. While the use of stainless steel would be more expensive, it provides the additional advantage of corrosion-resistance. The inner wall 56 is preferably also formed from low alloy steel. However, the inner wall 56 is made two inches thick in order to provide ample structural rigidity and strength to the outer container 18. Disposed between the outer wall 54 and the inner wall 56 is a layer of Boro-Silicone. This material advantageously absorbs neutrons from neutron-emitting radioactive materials (such as transuranic elements), and further is a relatively good conductor of heat. It is a rubbery material easily cast, and may be melted and poured between the inner and outer walls 54, 56 of the outer container 18 during its manufacture. Boro-Silicone is available from Reactor Experiments, Inc.

The bottom of the outer container 18 is formed by an end plate assembly 15 that includes an outer plate 60, an inner plate 62, and a layer of center shielding material 64. In the preferred embodiment, the outer plate 60 is again formed from a low alloy steel approximately one-fourth inch thick. The inner plate 62, like the inner wall 56, is again formed from a layer of low alloy steel approximately two inches thick. The center shielding material 64 is again preferably Boro-Silicone for all the reasons mentioned in connection with the center shielding material 58 of the side walls of the container 18. The low alloy steel inner plate 62 is joined around the bottom edge of the inner wall 56*a* 360 degrees via weld joint 66. The top of the outer container 28 includes a forged ring of low alloy steel 68. This ring is preferably four inches thick throughout its length, and is integrally connected to the inner wall 56 of the container 18 by a 360 degree weld joint 69. The upper edge of the ring 68 is either threaded or stepped to accommodate one of the two types of improve closures 115*b* or 117*b*, as will be explained in detail hereinafter.

With specific reference now to FIGS. 3 and 5, the cask assembly 1 is formed from the outer container 18 and shell 20 in combination with one of two different shield inserts 22 (illustrated in FIG. 5). Each of the shield inserts 22, 23 is formed from an outer cylindrical wall 72 which is preferably one inch thick and a cylindrical inner wall 74 which is approximately one-fourth of an inch thick. Both walls are formed from AISI type 304 stainless steel. The corrosion resistance of stainless steel prevents the outer dimensions of the outer wall 74 from becoming distorted as a result of rust, which in turn helps advantageously to maintain a relatively tight, slack-free fit between the shield inserts 22, 23 and the interior of the outer container 18.

Each of the shield inserts 22 and 23 includes a layer of shielding material 76 between their respective outer and inner walls 72, 74. However, in shield insert 22, this shielding material is formed from a plurality of ring-like sections 78*a*, 78*b*, and 78*c* of either depleted uranium or tungsten. These materials have excellent gamma shielding properties, and are particularly well adapted to contain and shield radioactive material emitting high intensity gamma radiation. Of course, a single tubular layer of depleted uranium or tungsten could be used in lieu of the three stacked ring-like sections 78*a*, 78*b*, and 78*c*. However, the use of stacked ring-like sections is preferred due to the difficulty of fabricating and machining these metals. To effectively avoid radiation streaming at the junctions between the three sections, overlapping tongue and groove joints 79 (see FIG. 4A) are provided at each junction. By contrast, in shield insert 23, a layer of poured lead 80 is used as the shielding material 76. While lead is not as effective a gamma shield as depleted uranium, it is a better material to use in connection with high-neutron emitting materials, such as the transuranic elements. Such high neutron emitters can induce secondary neutron emission when depleted uranium is used as a shielding material. While such a secondary neutron emission is not a problem with tungsten, this metal is far more difficult and expensive to fabricate than lead, and is only marginally better as a gamma-absorber. Therefore, lead is a preferred shielding material when high-neutron emitting materials are to be transported. It should be noted that the radius of the interior of the shield inserts 22 and 23 will be custom dimensioned with a particular type of waste to be transported so that the inner wall 74 of the insert comes as close as possible into contact with the radioactive material contained therein. The Applicant has noted that fulfillment of the foregoing criteria provides the most effective shielding configuration per weight of shielding material. Additionally, the thickness and type of shielding material 76 will be adjusted in accordance with the activity of the material contained within the shield insert 22, 23 so that the surface radiation of the cask assembly 1 never exceeds 200 mr. The fulfillment of these two criteria maximizes the capacity of the cask assembly 1 to carry radioactive materials while simultaneously minimizing the weight of the cask.

FIGS. 4A and 4B illustrate the vent, purge, and drain assembly 90 of the outer container 18. This assembly 90 includes a threaded drain pipe 92 for receiving a drain plug 94. The inner end 96 of the drain plug 94 is conically shaped and seatable in sealing engagement with a complementary valve seat 97 located at the inner end of the pipe 92. Wrench flats 98 integrally formed at the outer end of the drain plug 94 allow the plug 94 to be easily grasped and rotated into or out of sealing engagement with the valve seat 97. A vent pipe 100 is obliquely disposed in fluid communication with the end of the drain pipe 92. A threaded vent plug 102 is engageable into and out of the vent pipe 100. A screw head 103 is provided at the outer end of the vent plug 102 to facilitate the removal or insertion of the threaded plug 102 into the threaded interior of the vent pipe 100. A drain tube 104 is fluidly connected at its upper end to the bottom of the valve seat 97 by way of a fitting 106. In the preferred embodiment, the drain tube 104 is formed from stainless steel, and is housed in a side groove 108 provided along the inner surface of the wall 56 of the outer container 18. As is most easily seen in FIG. 4B, the lower open end 109 of the drain tube 104 is disposed in a bottom groove 110 which extends through the shallowly conical floor 112 of the outer container 18.

In operation, the vent, purge, and drain assembly may be used to vent the interior of the outer container 18 by removing the vent plug 102 from the vent pipe 100, screwing an appropriate fitting (not shown) into the threaded vent pipe 100, in order to channel gases to a mass spectometer, and screwing the conical end 96 of the drain plug 94 out of sealing engagement with the valve seat 97. If drainage is desired, the drain plug 94 is removed. A suction pump is connected to the drain pipe 92 in order to pull out, via drain tube 104, any liquids which may have collected in the bottom groove 110 of the conical floor 112 of the outer container 18. Gas purging is preferably accomplished after draining by removing the vent plug 102, and connecting a source of inert gas to the drain pipe 92. The partial vacuum within the container 18 that was created by the suction pump encourages inert gas to flow down through the drain tube 104. Although not specifically shown, the interior of the drain plug 98 may be provided with one or more rupture discs to provide for emergency pressure relief in the event that the cask assembly 1 is exposed to a source of intense thermal radiation, such as a fire, over a protracted period of time.

The improved closures 13 used in connection with the cask assembly 1 may be either screw-type double-lidded closures 115*a*, 115*b* (illustrated in FIG. 3), or breech-lock double-lidded closures 117*a*, 117*b* (illustrated in FIG. 5).

With reference now to FIG. 3, each of the screw-type closures 115*a*, 115*b* includes an outer lid 120*a*, 120*b*, and an inner lid 122*a*, 122*b*. The inner lid 122*a*, 122*b* in turn includes an outer edge 124*a*, 124*b* which is seatable over a ledge 126*a*, 126*b* provided around the opening 128*a*, 128*b* of the shield insert 22 or the outer container 18 respectively. A gasket 130*a*, 130*b* circumscribes the outer edge 124*a*, 124*b* of each of the inner lids 122*a*, 122*b* of the two closures 115*a*, 115*b*. In the preferred embodiment, these gaskets 130*a*, 130*b* are formed of Viton because of its excellent sealing characteristics and relatively high temperature limit (392° F.) compared to other elastomers. The gasket 130*a*, 130*b* of each of the inner lids 122*a* and 122*b* is preferably received and held within an annular recess (not shown) that circumscribes the outer edge 124*a*, 124*b* of each lid. Each of these gaskets 130*a*, 130*b* is capable of effecting a fluid-tight 360 degree seal between the outer edge 124*a*, 124*b* of each of the inner lids 122*a*, 122*b* and the ledges 126*a*, 126*b*. To facilitate the insertion of shield insert 22 into the container 18, it is important to note that the opening 128*b* of the container 18 is at least as wide as the interior of the container 18 at all points.

Each of the outer lids 120*a*, 120*b* of the screw-type closures 115*a*, 115*b* includes a threaded outer edge 134*a*, 134*b* which is engageable within a threaded inner edge 136*a*, 136*b* that circumscribes the openings 128*a*, 128*b* of the shield insert 22 and the outer container 18 respectively. Swivel hooks 137*a*, 137*b* (indicated in phantom) may be detachably mounted to the centers of the outer lids 120*a*, 120*b* to facilitate the closure operation. Finally, both of the outer lids 120*a*, 120*b* of the screw-type closures 115*a*, 115*b* includes a plurality of sealing bolts 138*a–h*, 139*a–h*, threadedly engaged in bores extending all the way through the outer lids 120*a*, 120*b* for a purpose which will become apparent shortly.

To seal the cask assembly 1, inner lid 122*a* is lowered over ledge 126*a* of the shield insert 22 so that the gasket 130 is disposed between the outer edge 124*a* of the inner lid 122*a* and ledge 126*a*. The detachably mountable swivel hook 137 is mounted onto the center of the outer lid 120*a*. The outer lid 120*a* is then hoisted over the threaded inner edge 136*a* of the shield insert 22. The threaded outer edge 134*a* of the outer lid 120*a* is then screwed into the threaded inner edge 136*a* to the maximum extent possible. The axial length of the screw threads 134*a* and 136*a* are dimensioned so that, after the outer lid 120*a* is screwed into the opening 128*a* to the maximum extent possible, a gap will exist between the inner surface of the outer lid 120*a* and the outer surface of the inner lid 122*a*. Once this has been accomplished, the securing bolts 138*a–h* are each screwed completely through their respective bores in the outer lid 120*a* so that they come into engagement with the inner lid 122*a*, thereby pressing the gasket 130*a* and into sealing engagement between the ledge 126*a* and the outer edge 124*a* of the lid 122*a*. The particulars of this last step will become more apparent with the description of the operation of the breech-lock double-lidded closures 117*a*, 117*b* described hereinafter. To complete the closure of the cask assembly 1, the outer screw-type closure 115*b* is mounted over the opening 128*b* of the outer container 18 in precisely the same fashion as described with respect to the opening 128*a* of the shield insert 22.

With reference now to FIGS. 5, 6A, and 6B, the breech-lock double-lidded closure 117*a*, 117*b* also includes a pair of outer lids 140*a*, 140*b* which overlie a pair of inner lids 142*a*, 142*b* respectively. Each of the inner lids 142*a*, 142*b* likewise includes an outer edge 144*a*, 144*b* which seats over a ledge 146*a*, 146*b* that circumscribes the opening 148*a*, 148*b* of the shielding insert 23 and outer container 18, respectively. Each of the outer edges 144*a*, 144*b* is circumscribed by a gasket 150*a*, 150*b* for effecting a seal between the edges 144*a*, 144*b* and their respective ledges 146*a*, 146*b*. Like opening 128*b*, opening 148*b* is at least as wide as the interior of the outer container 18.

Thus far, the structure of the breech-lock double-lidded closures 117*a*, 117*b* has been essentially identical with the previously described structure of the screw-type double-lidded closures 115*a*, 115*b*. However, in lieu of the previously described screw threads 134*a*, 134*b*, the outer edges 154*a*, 154*b* of each of the outer lids 140a, 140b are circumscribed by a plurality of uniformly spaced arcuate notches 156a, 156b which define a plurality of arcuate flanges 158a, 158b. Similarly, the inner edges 160a, 160b which circumscribe each of the openings 148a, 148b of the shield insert 23 and outer container 18, respectively, include notches 162a, 162b which also define arcuate flanges 164a, 164b. The flanges 158a, 158b which circumscribe each of the outer lids 140a, 140b are dimensioned so that they are insertable through the arcuate notches 162a, 162b which circumscribe the inner edges 160a, 160b of the shield insert 23 and the outer container 18. As may best been seen in FIG. 6A and 6C, such dimensioning allows the flanges 164a, 164b of each of the outer lids 140a, 140b, to be inserted through the notches 162a, 162b of each of the openings 148a, 148b and rotated a few degrees to a securely locked position wherein the arcuate flanges 158a, 158b of the outer lids 140a, 140b are overlapped and captured by the arcuate flanges 164a, 164b that circumscribe the inner edges 160a, 160b. It should be further noted that the axial length L1 (illustrated in FIG. 6B) of the interlocking flanges 158a, 158b and 164a, 164b is sufficiently short to leave a small gap L2 between the inner surface of the outer lids 140a, 140b and the outer surface of the inner lids 142a, 142b. The provision of such a small distance L2 between the outer and inner lids allows the outer lids 140a, 140b to be rotated a few degrees into interlocking relationship with their respective notched inner edges 160a, 160b without transmitting any rotary motion to the inner lids 142a, 142b which could cause the inner lid gaskets 150a, 150b to scrape or wipe across their respective ledges 146a, 146b.

Connected around the outer edges of the outer lids 140a, 140b are three suspension pin assemblies 166a, 166b, and 166c and 167a, 167b, and 167c (not shown) respectively. Each of these suspension pin assemblies 166a, 166b, 166c and 167a, 167b, 167c are uniformly spaced 120 apart on the edges of their respective outer lids 140a, 140b. As the structure of each suspension pin assembly is the same, only a suspension pin assembly 166a will be described.

With reference now to FIG. 6C, suspension pin assembly 166a includes a suspension pin 168 which is slidably movable along an annular groove 170 provided around the circumference of each of the inner lids 142a, 142b. A simple straight-leg bracket 172 connects the suspension pin 168 to the bottom edge of its respective outer lid.

In operation, the suspension pin assemblies 166a, 166b, 166c and 167a, 167b, 167c, serve two functions. First, the three suspension pin assemblies attached around the edges of the two outer lids 140a and 140b mechanically connect and thus unitize the inner and outer lids of each of the breech-lock closures 117a, 117b so that both the inner and the outer lids of each of the closures 177a and 117b may be conveniently lifted and lowered over its respective opening 148a, 148b in a single convenient operation. Secondly, the pin-and-groove interconnection between the inner and the outer lids of each of the two breech-lock type closures 117a and 117b allows the outer lids 140a and 140b to be rotated the extent necessary to secure them to the notched outer edges 160a, 160b of their respective containers without imparting any significant amount of torque to their respective inner lids 142a, 142b. This advantageous mechanical action in turn prevents the gaskets 150a and 150b from being wiped or otherwise scraped across their respective ledges 146a, 146b. In the preferred embodiment, the width of the groove 170 is deliberately made to be substantially larger than the width of the pin 168 so that the pin 168 may avoid any contact with the groove 170 when the outer lids 140a, 140b are rotated into interlocking relationship with their respective containers 23 and 18.

With reference again to FIG. 6A and 6C, each of the outer lids 140a, 140b includes eight sealing bolts 174a–h, 174.1a–h equidistantly disposed around its circumference. Each of these sealing bolts 174a–h, 174.1a–h is receivable within a bore 175 best seen in FIG. 6C.

Each of these bores 175 includes a bottom-threaded portion 176 which is engageable with the threads 176.1 of its respective bolt 174a–h, 174.1a–h as well as a centrally disposed, non-threaded housing portion 177. At its upper portion the bore 175 includes an annular retaining shoulder 178 which closely circumscribes the shank 179 of its bolt 174a–h, 174.1a–h. The retaining shoulder 178 insures that none of the sealing bolts 174a–h, 174.1a–h will inadvertently fall out of its respective bore 175 in the outer lid 140a, 140b. In operation, each of the sealing bolts 174a–h, 174.1a–h is screwed upwardly into its respective bore 175 until its distal end 179.1 is recessed within the threaded portion 176 of the bore 175. After the outer lid 140a or 140b has been secured into the notched inner edge 160a or 160b of its respective container 23 or 18, the sealing bolts 174a–h, 174.1a–h are screwed down into the position illustrated in FIG. 6C until their distal ends 179.1 forcefully apply a downward-direction force around the outer edges 144a, 144b of their respective inner lids 142a, 142b. Such a force presses the gaskets 150a and 150b into sealing engagement against their respective ledges 146a, 146b. It should be noted that the same bolt and bore configuration as heretofore described is utilized in the screw-type double-lidded closures 115a, 115b.

To insure that the outer lids 140a and 140b will not become inadvertently rotated out of locking engagement with their respective vessels 23 or 18, a locking bracket 180 is provided in the position illustrated in FIG. 6A and 6B in each of the outer lids 140a, 140b after they are rotated shut. Each locking bracket 180 includes a lock leg 182 which is slid through mutually registering notches 156a, 156b, and 162a, 162b after the outer lids 140a and 140b have been rotated into locking engagement with the inner edges 160a, 160b of either the shielding insert 23 or the outer container 18. In the case of outer lid 140b, the mounting leg 184 is secured by means of locking nuts 186a, 186b. In the case of outer lid 140a, the mounting leg 184 is captured in place by inner lid 142b which abuts against it. Although not specifically shown in any of the drawings, each of the outer lids 120a, 120b of the screw-type double-lidded closures 115a, 115b is similarly secured. However, instead of a locking bracket 180, a locking screw (not shown) is screwed down through the outer edges of each of the outer lids 120a, 120b and against a recess present in each of the inner lids 122a, 122b.

We claim:

1. An improved closure for covering and sealing an opening in a single cask for containing radioactive material, wherein said opening is characterized by a ledge comprising:

a. an inner lid receivable within said opening and having a gasket means that is seatable over said ledge;

b. an outer lid which is likewise receivable into said opening and securable therearound when said outer lid is rotated relative to said opening, said inner lid remaining stationary relative to said cask opening when said outer lid is rotated and having no torque applied thereto by said outer lid when said outer lid is rotated, and c. bolt means threadedly mounted through said outer lid for applying a compressive force between said inner and outer lids after said outer lid has been secured to said opening in order to depress the gasket means of said inner lid into sealing engagement with said ledge while avoiding the application of torsion between said gasket means and said ledge.

2. The improved closure defined in claim 1, further including screw threads disposed around both said outer lid and said opening for securing said outer lid around said opening.

3. The improved closure defined in claim 1, further including means for securing said outer lid to said opening upon a relative rotation of 120° or less between said outer lid and said opening.

4. The improved closure defined in claim 1, further including a breech-lock means for securing said outer lid to said opening formed by a first set of flanges uniformly spaced around said opening, and a second set of flanges spaced around said outer lid that are insertable through the spaces between said first set of flanges and movable therebehind when said outer lid is rotated.

5. The improved closure defined in claim 1, further including means for rotatably connecting said inner lid and outer lid that is formed at least in part by a plurality of pin means connected to one of said lids that are receivable within a groove located in the other of said lids.

6. The improved closure defined in claim 5, wherein the rotatable connection means includes three suspension pin assemblies substantially uniformly spaced around one of said lids, and a groove located around at least part of the edge of the other lid, and wherein said suspension pin assemblies each include a pin that is captured within and slidably movable along said groove.

7. The improved closure defined in claim 4, further including a lock means formed in part by a bracket that is detachably connectable to the outer lid, and which has a leg which is insertable between two of the flanges that surround said opening after said second set of flanges has been inserted through and moved behind the first set of flanges in order to lock said outer lid to the cask.

8. An improved closure for covering and sealing an opening in a single cask for containing radioactive material, wherein said opening is circumscribed by a ledge, comprising:

a. an inner lid receivable within said opening and having an outer edge that is seatable over said ledge and which includes a gasket means;

b. an outer lid which is likewise receivable into said opening;

c. means for detachably securing said outer lid to said opening when said outer lid is rotated relative to said opening so that said gasket means of said inner lid will remain stationary over said ledge when said outer lid is rotatably secured within said opening, and d. bolt means threadedly mounted through said outer lid for applying a compressive force between said inner and outer lids to depress the outer edge of the inner lid against said ledge after said outer lid is secured thereover and around said opening without the application of torsion between said gasket means and said ledge in order to effect a seal therebetween, wherein said bolt means is withdrawn out of contact with said inner lid when said outer lid is secured to said cask and then extended into compressive engagement against said inner lid after said outer lid has been so secured.

9. The improved closure defined in claim 8, wherein said securing means includes complementary screw threads circumscribing the outer edge of the outer lid and the inner edge of the cask opening.

10. The improved closure defined in claim 8, wherein said means for detachably securing said outer lid to said opening includes breech-lock means formed by a first set of flanges uniformly spaced around said opening, and a second set of flanges spaced around said outer lid that are insertable through the spaces between said first set of flanges and movable therebehind when said outer lid is rotated.

11. The improved closure defined in claim 10, further including means for rotatably connecting said inner lid to said outer lid including three suspension pin assemblies substantially uniformly spaced around one of said lids, and a groove located around at least part of the edge of the other lid, and wherein said suspension pin assemblies each include a pin that is captured within and slidably movable along said groove.

12. The improved closure defined in claim 11, further including a lock means formed in part by a bracket that is detachably connectable to the outer lid, and which has a leg which is insertable between two of the flanges that surround said opening after said second set of flanges has been inserted through and moved behind the first set of flanges in order to prevent the outer lid from rotatably moving relative to the inner lid.

13. The improved closure defined in claim 8, wherein said bolt means includes a plurality of bolts uniformly spaced from one another in a circular pattern.

14. The improved closure defined in claim 11, wherein each suspension pin assembly further includes a bracket member for connecting its respective pin to one of said lids.

15. An improved closure for covering and sealing a circular opening in a single cask for containing radioactive material, wherein said opening is circumscribed by a ledge, comprising:

a. an inner lid receivable within said opening and having an outer edge that is seatable over said ledge and which includes a gasket means for effecting a seal between said lid and said opening;

b. an outer lid which is likewise receivable into said opening and securable therearound over said inner lid;

c. breech-lock means for securing said outer lid to said opening, including a first set of flanges uniformly spaced around said opening, and a second set of flanges spaced around said outer lid, wherein said second set of flanges are insertable through the spaces between the first set of flanges and are movable therebehind when said outer lid is rotated relative to the opening;

d. means for rotatably interconnecting said inner lid with said outer lid to facilitate the installation of both lids simultaneously in the cask opening, and to prevent the inner lid from moving when said outer lid is rotated to secure the same to the cask opening, and e. bolt means threadedly mounted through said outer lid for applying a compressive force between said inner and outer lids after said outer lid has been secured to said opening to depress the outer edge of the inner lid against said ledge while avoiding the application of torsion between said inner and outer lids when said outer lid is secured to said opening, wherein said gasket means is prevented from rubbing against said ledge when said lids are installed in the cask.

* * * * *